US009559397B2

(12) United States Patent
Adams et al.

(10) Patent No.: US 9,559,397 B2
(45) Date of Patent: Jan. 31, 2017

(54) CIRCULAR DIELECTRIC POLARIZER HAVING A DIELECTRIC SLAB SANDWICHED BY DIELECTRIC CORE PORTIONS HAVING AIR CUTOUTS THEREIN

(71) Applicant: The Boeing Company, Chicago, IL (US)

(72) Inventors: Alec Adams, Woodway, WA (US); Bruce L. Blaser, Auburn, WA (US)

(73) Assignee: The Boeing Company, Chicago, IL (US)

( * ) Notice: Subject to any disclaimer, the term of this patent is extended or adjusted under 35 U.S.C. 154(b) by 336 days.

(21) Appl. No.: 14/249,075

(22) Filed: Apr. 9, 2014

(65) Prior Publication Data

US 2016/0172732 A1 Jun. 16, 2016

(51) Int. Cl.
*H01P 1/17* (2006.01)
*H01P 1/165* (2006.01)

(52) U.S. Cl.
CPC ..... *H01P 1/172* (2013.01); *H01P 1/165* (2013.01)

(58) Field of Classification Search
CPC ..... H01P 1/163; H01P 1/165; H01P 1/17; H01P 1/172; H01P 1/182
USPC ..... 333/21 A
See application file for complete search history.

(56) References Cited

U.S. PATENT DOCUMENTS 3,161,839 A * 12/1964 Levinson ..... H01P 1/165 333/159
3,787,787 A * 1/1974 Shimada et al. ..... H01P 1/163 333/21 R
5,304,999 A * 4/1994 Roberts et al. ..... H01Q 21/245 333/117
6,356,164 B1 * 3/2002 Rowatt ..... H01P 1/18 333/157

FOREIGN PATENT DOCUMENTS

JP 5715501 A 1/1982
JP 61264801 A 11/1986

OTHER PUBLICATIONS

Meier et al.; "Wide-Band Polarizer in Circular Waveguide Loaded with Dielectric Discs"; IEEE Transactions on Microwave Theory and Techniques; Nov. 1965; vol. MTT-13 No. 6; p. 763-767.

(Continued)

*Primary Examiner* — Benny Lee
(74) *Attorney, Agent, or Firm* — Baker & Hostetler LLP

(57) ABSTRACT

A circular dielectric polarizer can have a cylindrical shape and include a dielectric slab, a dielectric core, and at least one air cutouts portions of the dielectric core. The dielectric slab can include a first dielectric material and have a thickness centered about an axis of the cylindrical shape. The dielectric core can include a second dielectric material. Portions of the dielectric core can be located on different sides of the dielectric slab. The dielectric core and the dielectric slab can form the cylindrical shape. The dielectric constant of the first dielectric material can be higher than a dielectric constant of the second dielectric material. Parameters of the circular dielectric polarizer, the dielectric slab, the dielectric core, and the at least one air cutout are selected to obtain approximately a 90 degree difference in phase in a signal passing through the circular dielectric polarizer at a target frequency.

18 Claims, 7 Drawing Sheets

(56) References Cited

OTHER PUBLICATIONS

Chang et al.; Propagation of Electromagnetic Waves in a Partially Dielectric Filled Circular Waveguide; Journal of Applied Physics; 1970; vol. 41 No. 11; p. 4493-4500.
International Patent Application No. PCT/US2015/012939; Int'l Search Report and the Written Opinion; dated Apr. 28, 2015; 12 pages.
International Patent Application No. PCT/US2015/012939; Int'l Preliminary Report on Patentability; dated Oct. 20, 2016; 8 pages.

* cited by examiner

CIRCULAR DIELECTRIC POLARIZER HAVING A DIELECTRIC SLAB SANDWICHED BY DIELECTRIC CORE PORTIONS HAVING AIR CUTOUTS THEREIN

BACKGROUND

The present disclosure relates generally to antennas and, in particular, to wave guide polarizers for antennas. Still more particularly, the present disclosure relates to circular polarizers for antennas.

A phased array antenna is a group of antennas in which the relative phases of the respective signals feeding the antennas may be varied in a way that the effect of a radiation pattern of the array is reinforced in a desired direction and suppressed in undesired directions. In other words, one or more beams may be generated that may be pointed in or steered into different directions. A beam pointing in a transmitting or receiving phased array antenna is achieved by controlling the phasing timing of the transmitted or received signal from each antenna element in the array.

The individual radiated signals are combined to form the constructive and destructive interference patterns of the array. A phased array antenna may be used to point one or more fixed beams or to scan one or more beams rapidly in azimuth or elevation.

Each antenna element in a phased array antenna may employ a polarizer. This polarizer converts a signal in a circular polarized form to a linearly polarized form or vice versa. Signals that are transmitted from an antenna may be converted from a linear polarized form to a circular polarized form for transmission. The conversion for an array receiving a signal is converted from circular to linear polarization. This conversion can be accomplished by these same devices. Further discussion is limited to the transmit case for brevity but inversely (conversion from circular to linear) also applies for the receive case. A polarizer may be placed within a waveguide and may be formed using different dielectric materials.

It is desirable to transform a linear polarized signal in a circular waveguide into a circular polarized signal in a manner with low loss, good matching, and a good fit within the cross section of the waveguide. Existing solutions for polarizers may involve a non-circular cross section in the waveguide to obtain the desired polarization of signals. These types of waveguides may require expensive manufacturing techniques. Further, these types of polarizers also may be more difficult to match.

SUMMARY OF THE INVENTION

Illustrative examples of the present disclosure include, without limitation, methods, structures, and systems. In one aspect, a circular dielectric polarizer can have a cylindrical shape and include a dielectric slab, a dielectric core, and at least one air cutout portions of the dielectric core. The dielectric slab can include a first dielectric material and have a thickness centered about an axis of the cylindrical shape. The dielectric core can include a second dielectric material. Portions of the dielectric core can be located on different sides of the dielectric slab. The dielectric core and the dielectric slab can form the cylindrical shape. The dielectric constant of the first dielectric material can be higher than a dielectric constant of the second dielectric material. Parameters of the circular dielectric polarizer, the dielectric slab, the dielectric core, and the at least one air cutout are selected to obtain approximately a 90 degree difference in phase in a signal passing through the circular dielectric polarizer at a target frequency.

In one example, the air cutout can have a substantially uniform cross section throughout a length of the circular dielectric polarizer. The cross section can include an arc-shaped cross section with a constant radius. An air cutout in the first portion of the dielectric core and the second portion of the dielectric core can be located symmetrically about the axis of the circular dielectric polarizer.

In another example, the parameters of the circular dielectric polarizer, the dielectric slab, the dielectric core, and the at least one air cutout can include one or more of a thickness of the dielectric slab, a diameter of the circular dielectric polarizer, a length of the circular dielectric polarizer, a width of the at least one air cutout, and an air cutout diameter. In another example, the parameters of the circular dielectric polarizer, the dielectric slab, the dielectric core, and the at least one air cutout can include one or more of a dielectric constant of the first dielectric material and a dielectric constant of the second dielectric material.

In another example, the circular dielectric polarizer can also include a container located around the dielectric slab and the dielectric core. The container can be configured to hold the dielectric core and the dielectric slab in the cylindrical shape. The container can include a metal tube. In yet another example, the target frequency can be 44.5 GHz with a bandwidth of 2 GHz.

In another aspect, a circular dielectric polarizer can have a cylindrical shape and include a tapered dielectric slab and a dielectric core. The tapered dielectric slab can include a first dielectric material and have a thickness centered about an axis of the cylindrical shape. The tapered dielectric slab can include at least a first tapered side. The dielectric core can include a second dielectric material. A first portion of the dielectric core can be located on a first side of the tapered dielectric slab and a second portion of the dielectric core can be located on a second side of the tapered dielectric slab. The first portion of the dielectric core, the tapered dielectric slab and the second portion of the dielectric core can form the cylindrical shape. The dielectric constant of the first dielectric material can be higher than a dielectric constant of the second dielectric material. Parameters of the circular dielectric polarizer, the tapered dielectric slab, and the dielectric core can be selected to obtain approximately a 90 degree difference in phase in a signal passing through the circular dielectric polarizer at a target frequency.

In one example, the tapered dielectric slab can include a second tapered side. The first and second tapered sides can be symmetrical about the axis of the cylindrical shape. At least one portion of the dielectric core can include protrusions. The protrusions can be configured to fill at least one void of a taper of the tapered dielectric slab.

In another example, the parameters of the circular dielectric polarizer, the tapered dielectric slab and the dielectric core can include one or more of a thickness of the tapered dielectric slab, a diameter of the circular dielectric polarizer, a length of the circular dielectric polarizer, and a depth of a taper on the first tapered side. In another example, the parameters of the circular dielectric polarizer, the tapered dielectric slab and the dielectric core can include one or more of a dielectric constant of the first dielectric material and a dielectric constant of the second dielectric material.

In another example, the circular dielectric polarizer can also include a container located around the tapered dielectric slab and the dielectric core. The container can be configured to hold the first portion of the dielectric core, the tapered dielectric slab and the second portion of the dielectric core in the cylindrical shape. The container can include a metal tube.

Other features of the methods, structures, and systems are described below. The features, functions, and advantages can be achieved independently in various examples or may be combined in yet other examples, further details of which can be seen with reference to the following description and drawings.

BRIEF DESCRIPTION OF THE DRAWINGS

Throughout the drawings, reference numbers may be re-used to indicate correspondence between referenced elements. The drawings are provided to illustrate examples described herein and are not intended to limit the scope of the disclosure.

DETAILED DESCRIPTION OF THE INVENTION

Figure 1:
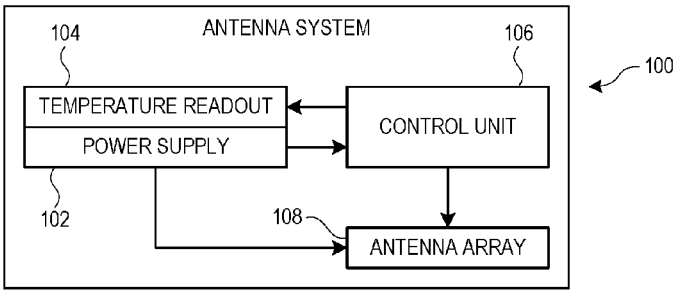
FIG. 1 depicts a diagram illustrating a configuration of an antenna system in accordance with one embodiment.

With reference now to the figures and, in particular, with reference to FIG. 1, a diagram illustrating a configuration of an antenna system is depicted in accordance with one embodiment. In this example, antenna system 100 includes power supply 102, temperature readout 104, control unit 106, and antenna array 108. In these illustrative examples, power supply 102 provides power to control unit 106 and antenna array 108.

Control unit 106 controls the array pointing angle for antenna array 108. Antenna array 108 may be either a single- or multi-beam antenna. Antenna array 108 also may be a transmit antenna and/or receive antenna in these illustrative examples.

Control unit 106 takes data from antenna array 108 and sends that data to temperature readout 104 for presentation to an operator and for automatic power down features. In the different embodiments, antenna array 108 may employ circular polarizers according to one or more different embodiments.

Figure 2:
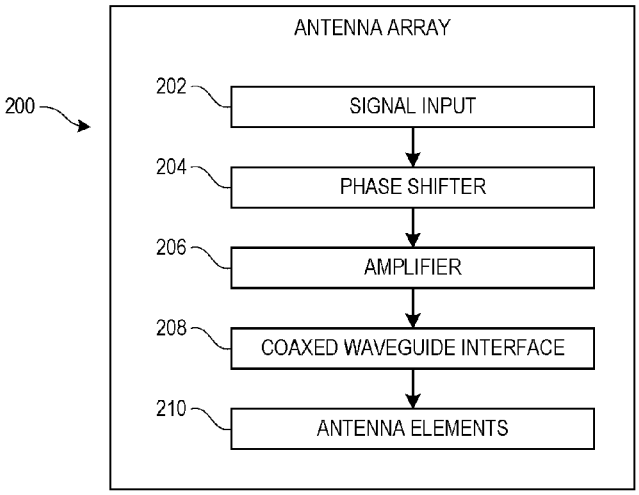
FIG. 2 depicts a diagram illustrating an antenna array in accordance with one embodiment.

With reference now to FIG. 2, a diagram illustrating an antenna array is depicted in accordance with one embodiment. In this example, antenna array 200 is an example of one implementation for antenna array 108 in FIG. 1. As illustrated, antenna array 200 includes signal input 202, phase shifter 204, amplifier 206, coaxial (or coaxed) coaxed waveguide interface 208, and antenna elements 210.

Signal input 202 may receive a radio frequency (RF) signal for transmission. Phase shifter 204 performs phase shifting of signals in accordance with instructions from control unit 106 in FIG. 1. Amplifier 206 amplifies the radio frequency signal output of phase shifter 204 for transmission. Coaxed waveguide interface 208 provides a connection from amplifier 206 to antenna elements 210.

Figure 3:
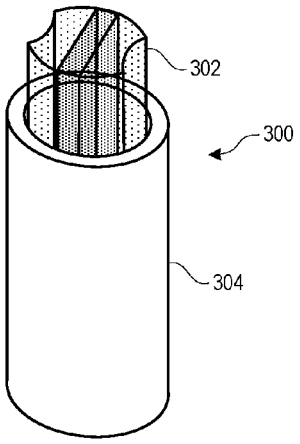
FIG. 3 depicts a diagram illustrating an antenna element in accordance with one embodiment

With reference now to FIG. 3, a diagram illustrating an antenna element is depicted in accordance with one embodiment. In this example, polarizer 300 is an example of a subcomponent of an antenna element within antenna elements 210 in FIG. 2. Polarizer 300 is an antenna that may be formed by polarizing dielectrics 302 and circular waveguide 304.

The different embodiments may be implemented in polarizer 300 to provide for polarization in a manner that may include low loss, good matching, and a good fit to a round cross section for antenna element 210. Antenna element 210 may receive a linear signal from coaxed waveguide interface 208. This linear signal can be described as two equal orthogonal vectors that, when summed together, equal the input linear signal. The linear signal may be circularly polarized by delaying one vector by around 90 degrees using polarizer 300. This delay may be referred to as shifting the vector relative to the other vector.

Figure 4:
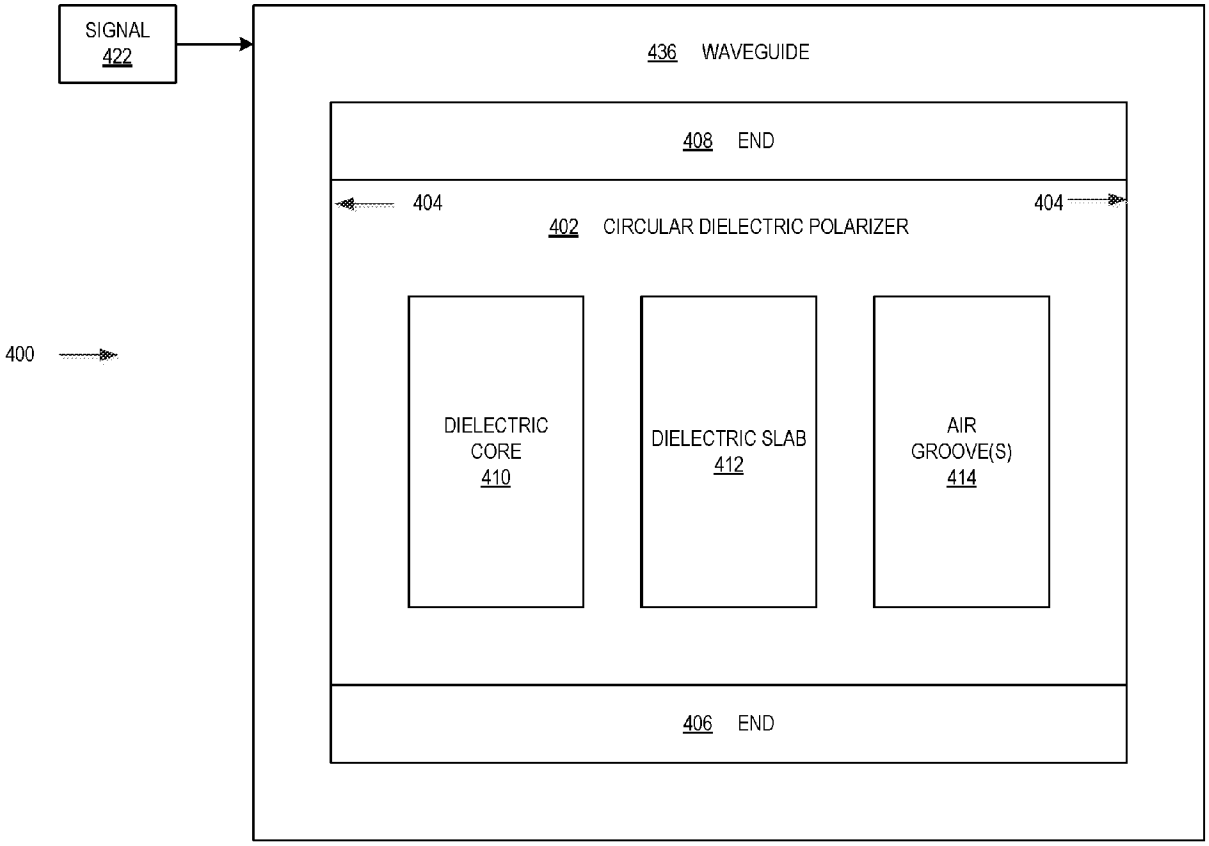
FIG. 4 depicts a diagram of a polarizer in accordance with one embodiment.

Referring now to FIG. 4, a diagram of a polarizer is depicted in accordance with one embodiment. In this example, polarizer 400 is an example of a polarizer that may be used to implement polarizer 300 in an antenna element in FIG. 3.

In FIG. 4, polarizer 400 has a circular dielectric polarizer 402, sidewalls 404, an end 406, and end 408. Circular dielectric polarizer 402 has a dielectric core 410, a dielectric slab 412, and one or more air cutouts 414. The dielectric slab 412 can have a greater dielectric constant (i.e., the relative permittivity) than the dielectric core 410. The one or more air cutouts or grooves 414 can be made in the dielectric core 410, effectively reducing the dielectric constant of the dielectric core. The ends 406 and 408 are optional and can be omitted in certain embodiments.

A number of factors may affect the performance of the circular dielectric polarizer 402, such as the width of the dielectric slab, the size or sizes of the one or more air cutouts, the type of dielectric material in the dielectric core 410, the type of dielectric material in the dielectric slab 412, the diameter of the circular dielectric polarizer 402, and the like. Each of these factors can be determined such that a phase shift occurs as signal 422 passes through circular dielectric polarizer 402. Signal 422 may have two equal orthogonal vectors. Signal 422 may be circular polarized by shifting one of these vectors by around 90 degrees. The phase shift obtained using the circular dielectric polarizer 402 can be about a 90 degree difference in phase as signal 422 passes through dielectric polarizer 402. The circular dielectric polarizer 402 can be used to convert a circular polarized signal to a linear polarized signal, and to convert a linear polarized signal to a circular polarized signal.

In some examples, the polarizer 400 may have a waveguide 436. The waveguide 436 may be in the form of a metal tube or any other form. The waveguide 436 may be formed as an integral part of the polarizer 400 so that a separate waveguide may not need to be used with polarizer 400. Such a design may reduce the weight and complexity for creating antenna elements.

Figure 5:
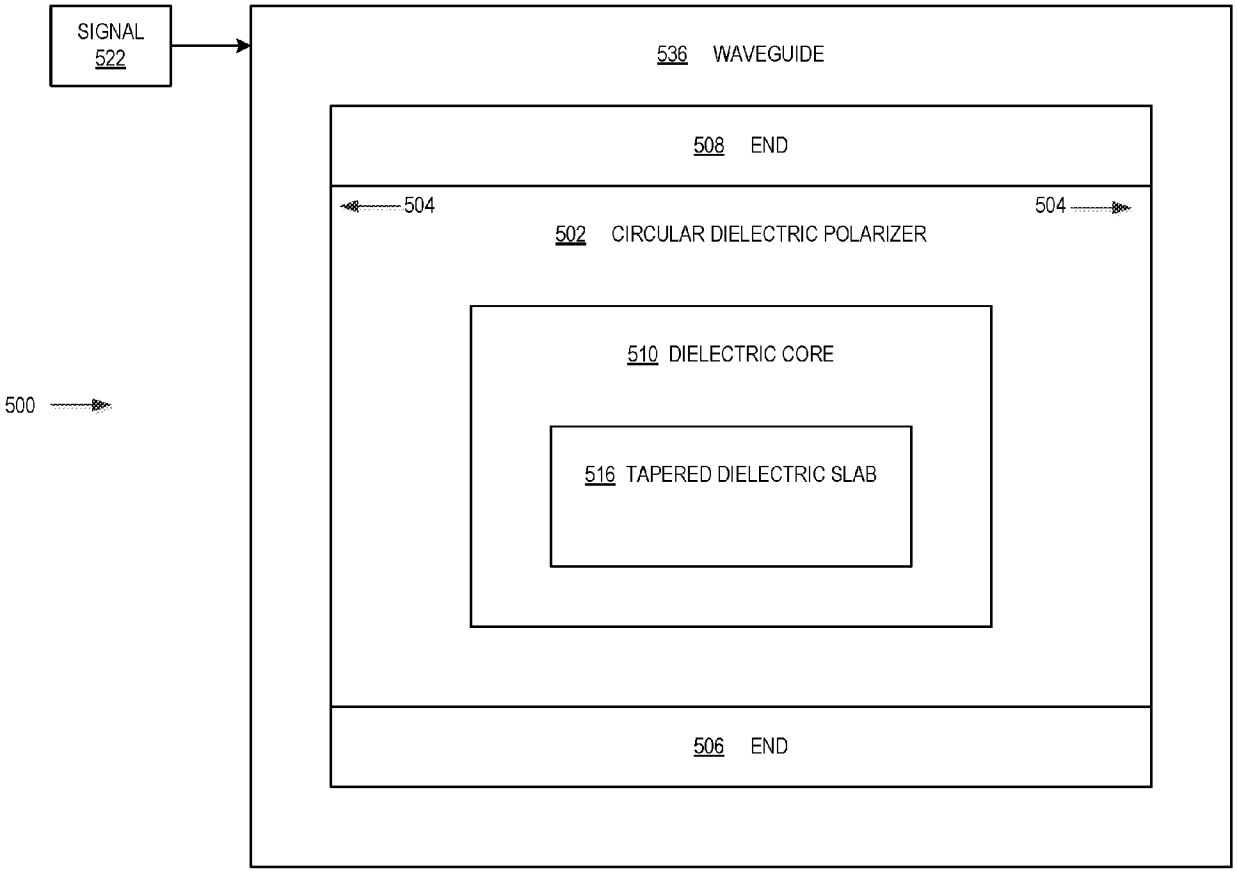
FIG. 5 depicts a diagram of a polarizer in accordance with one embodiment.

Referring now to FIG. 5, a diagram of a polarizer is depicted in accordance with one embodiment. In this example, polarizer 500 is an example of a polarizer that may be used to implement polarizer 300 in an antenna element in FIG. 3.

In FIG. 5, polarizer 500 has a circular dielectric polarizer 502, sidewalls 504, an end 506, and end 508. Circular dielectric polarizer 502 has a dielectric core 510 and a tapered dielectric slab 516. The tapered dielectric slab 516 can have a greater dielectric constant (i.e., the relative permittivity) than the dielectric core 510. The tapered dielectric slab 516 can also have a taper at a location away from the ends of the circular dielectric polarizer 502 such that the cross section of the tapered dielectric slab 516 is not uniform throughout the dielectric polarizer 502.

A number of factors may affect the performance of the circular dielectric polarizer 502, such as the width of the tapered dielectric slab 516, the depth of the taper of the tapered dielectric slab 516, the type of dielectric material in the dielectric core 510, the type of dielectric material in the tapered dielectric slab 516, the diameter of the circular dielectric polarizer 502, and the like. Each of these factors can be determined such that a phase shift occurs as signal 522 passes through circular dielectric polarizer 502. Signal 522 may have two equal orthogonal vectors. Signal 522 may be circular polarized by shifting one of these vectors by around 90 degrees. The phase shift obtained using the circular dielectric polarizer 502 can be about a 90 degree difference in phase as signal 522 passes through dielectric polarizer 502. The circular dielectric polarizer 502 can be used to convert a circular polarized signal to a linear polarized signal, and to convert a linear polarized signal to a circular polarized signal.

In some examples, the polarizer 500 may have a waveguide 536. The waveguide 536 may be in the form of a metal tube or any other form. The waveguide 536 may be formed as an integral part of the polarizer 500 so that a separate waveguide may not need to be used with polarizer 500. Such a design may reduce the weight and complexity for creating antenna elements.

Figure 6B:
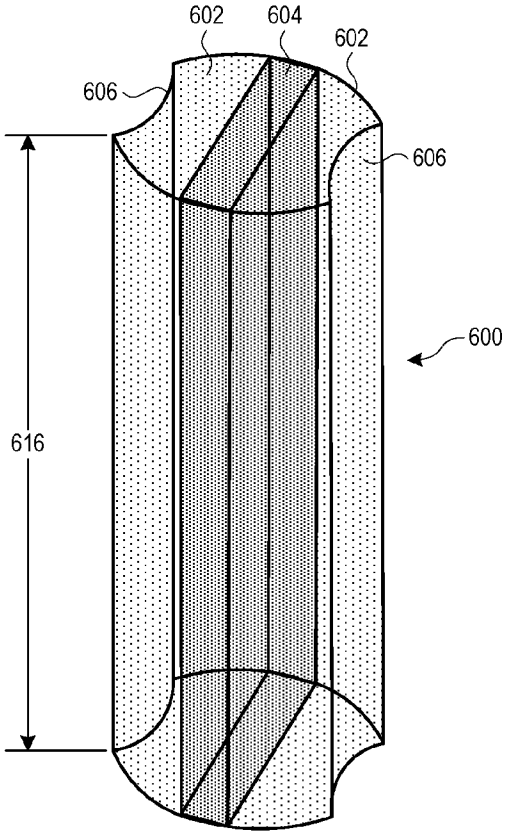
FIGS. 6A and 6B depict two views of one embodiment of a circular dielectric polarizer.
Figure 6A:
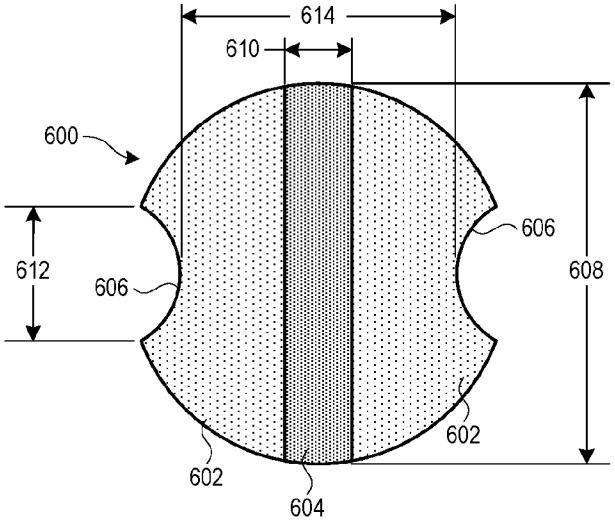

Referring now to FIGS. 6A and 6B, depicted are two views of one embodiment of a circular dielectric polarizer 600. FIG. 6A depicts and end view of the circular dielectric polarizer 600 and FIG. 6B depicts an isometric view of the circular dielectric polarizer 600. The circular dielectric polarizer 600 includes a dielectric core 602 and a dielectric slab 604. Together, the dielectric core 602 and the dielectric slab 604 are generally cylindrical in shape that has a diameter 608 FIG. 6A and is centered about an axis of the circular dielectric polarizer 600. The dielectric slab 604 can have a thickness 610 FIG. 6A that is centered about the axis of the circular dielectric polarizer 600.

The dielectric core 602 can be in two parts, as shown in FIGS. 6A and 6B. Each of the parts of the dielectric core 602 can have an air cutout 606. The air cutouts shown in FIGS. 6A and 6B run from one end of the circular dielectric polarizer 600 to the other end of the circular dielectric polarizer 600 with substantially a uniform cross section throughout a length 616 of the circular dielectric polarizer 600. The air cutouts 606 can have a depth such that an air cutout diameter 614 FIG. 6A (i.e., the distance between the two air cutouts 606) is a particular distance. The air cutouts 606 can also have a width 612 FIG. 6A. The air cutouts 606 can have an arc-shaped cross section with a constant radius or the air cutouts 606 can have any other shape of cross section. The air cutouts can be located symmetrically about the axis of the circular dielectric polarizer 600.

The various parameters (e.g., sizes and materials) of the dielectric core 602, the dielectric slab 604, and the air cutouts 606 can be selected to tune the circular dielectric polarizer 600 to a particular frequency. For example, as the thickness 610 of the dielectric slab 604 increases, the slower the phase velocity of a signal passing through the dielectric slab 604. In another example, the greater the width 612 of the cutout 606 and/or the air cutout diameter 614 of the cutout 606, the lower the effective dielectric constant of the dielectric core 602. In another example, the greater the length 616 FIG. 6B of the circular dielectric polarizer 600, the longer that signals will pass through the materials of the dielectric core 602 and the dielectric slab 604. In operation, a signal can be received via one end of the circular dielectric polarizer 600, the signal can pass through the circular dielectric polarizer 600, and the signal can be emitted from the other end of the circular dielectric polarizer 600. As the signal passes through the circular dielectric polarizer 600, the parameters of the circular dielectric polarizer 600, the dielectric slab 604, the dielectric core 602, and the air cutouts 606 cause approximately a 90 degree difference in phase of the signal.

In one particular example, the circular dielectric polarizer 600 can be tuned to a center frequency of 44.5 GHz with a bandwidth of 2 GHz. The dielectric core 602 can be made of a material with a dielectric constant of K=2.54 and a loss tangent of 0.0005. The dielectric slab 604 can be made of a material with a dielectric constant of K=4 and a loss tangent of 0.0005. The thickness 610 of the dielectric slab 604 can be 19.4 mils, the width 612 of the air cutouts 606 can be 51.2 mils, the diameter 608 of the circular dielectric polarizer 600 can be 114 mils, the air cutout diameter 614 between the air cutouts 606 can be 73.2 mils, and the circular dielectric polarizer 600 can have a length 616 of 242.5 mils.

Figure 7B:
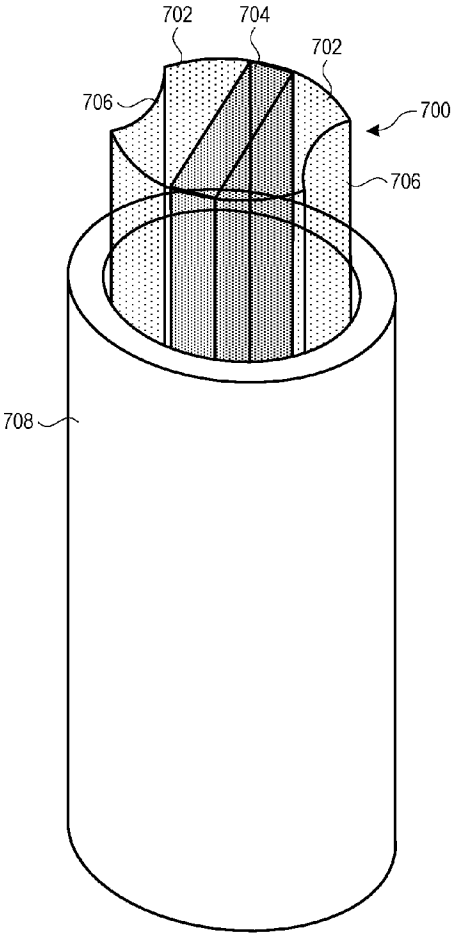
FIGS. 7A and 7B depict an example of how a circular dielectric polarizer can be formed.
Figure 7A:
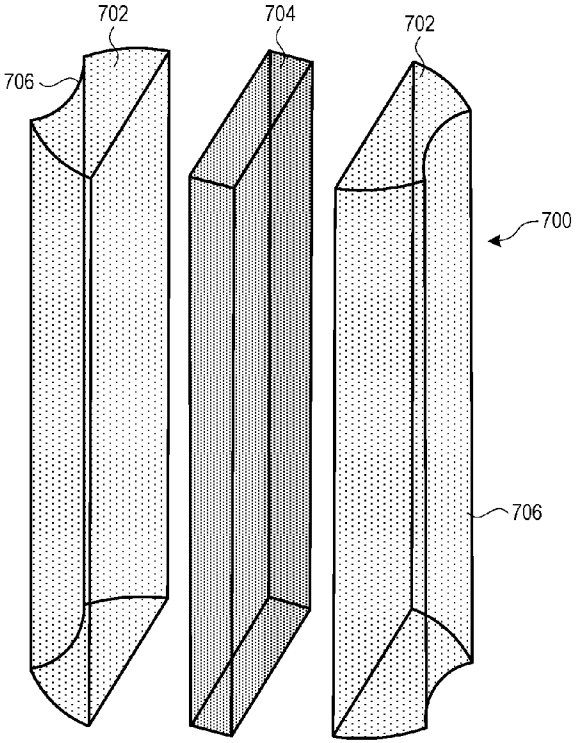

FIGS. 7A and 7B depict an example of how a circular dielectric polarizer 700 can be formed. The embodiment of the circular dielectric polarizer 700 depicted in FIGS. 7A and 7B has three pieces: two pieces that make up a dielectric core 702 and third piece that makes up a dielectric slab 704. Each of the two dielectric cores 702 can have an air cutout 706. As shown in FIG. 7A, the three pieces of circular dielectric polarizer 700 can be formed separately. The dielectric cores 702 and the dielectric slab 704 can be brought together, as shown in FIG. 7B, and slid inside of a container 708, such as a metal tube. The dimensions of each of the dielectric cores 702 and the dielectric slab 704 can be such that, when the dielectric cores 702 and the dielectric slab 704 are brought together and held in container 708, the dielectric cores 702 and the dielectric slab 704 have the appropriate dimensions of the circular dielectric polarizer 700.

In the embodiment shown in FIG. 7B, the container 708 can be a metal tube that forms sidewalls, similar to the sidewalls 404 and 504 describes above with respect to FIGS. 4 and 5. The container 708 can serve to hold the dielectric cores 702 and the dielectric slab 704 as well as provide sidewalls to that the circular dielectric polarizer 700 can also function as a waveguide. In this respect, as a signal passes through the dielectric polarizer 700, the container 708 can guide the signal from one end of the dielectric polarizer 700 to the other end of the dielectric polarizer 700.

Figure 8C:
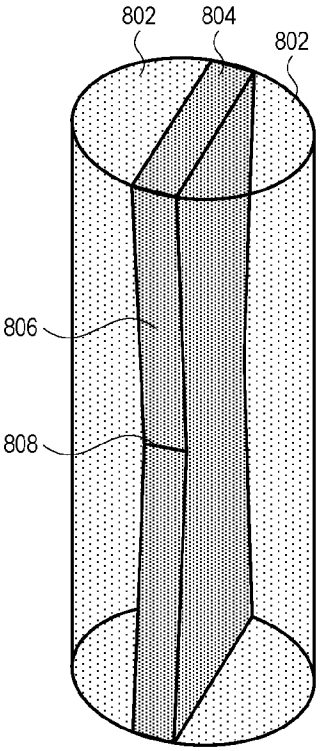
FIGS. 8A, 8B, and 8C depict views of one embodiment of a circular dielectric polarizer.
Figure 8B:
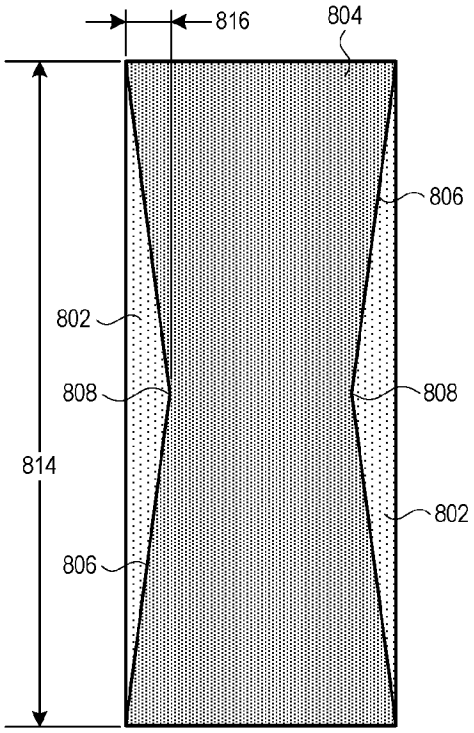
Figure 8A:
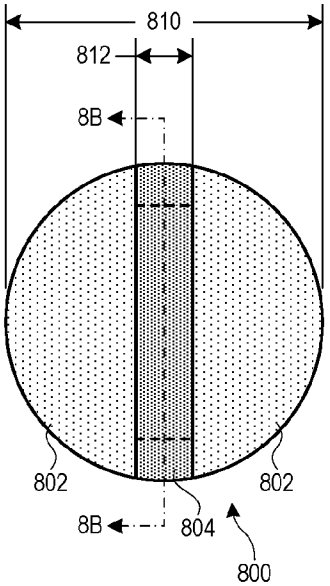

Referring now to FIGS. 8A, 8B, and 8C, depicted are three views of one embodiment of a circular dielectric polarizer 800. FIG. 8A depicts and end view of the circular dielectric polarizer 800, FIG. 8B depicts a cross-sectional view of the circular dielectric polarizer 800 along line 8B-8B of FIG. 8A, and FIG. 8C depicts an isometric view of the circular dielectric polarizer 800. The circular dielectric polarizer 800 includes a dielectric core 802 and a tapered dielectric slab 804. Together, the dielectric core 802 and the tapered dielectric slab 804 are generally cylindrical in shape that has a diameter 810 FIG. 8A and is centered about an axis of the circular dielectric polarizer 800.

The tapered dielectric slab 804 can have a width 812 FIG. 8A that is centered about the axis of the circular dielectric polarizer 800. The tapered dielectric slab 804 can have two, symmetrical tapers 806 FIGS. 8B and 8C. Each of the tapers 806 can come to a taper point 808 FIGS. 8B and 8C. The taper point 808 can be a depth 814 (FIG. 8B) inward from the edge of the circular dielectric polarizer 800. The area between the taper 806 and the edge of the circular dielectric polarizer 800 can be filled by the dielectric core 802. The tapers 806 of the tapered dielectric slab 804 can be linear, as shown in FIGS. 8B and 8C, with tapers 806 running linearly from one corner to taper point 808 and from the taper point 808 to another corner. The tapers 806 of the tapered dielectric slab 804 can have other forms, such as arc-shaped or other non-linear tapers 806.

The various parameters (e.g., sizes and materials) of the dielectric core 802 and the tapered dielectric slab 804 can be selected to tune the circular dielectric polarizer 800 to a particular frequency. For example, as the width 812 of the tapered dielectric slab 804 increases, the slower the phase velocity of a signal passing through the tapered dielectric slab 804. In another example, the deeper the depth 814 of the taper 806, the faster the phase velocity of a signal passing through the tapered dielectric slab 804. In another example, the greater the length 816 of the circular dielectric polarizer 800, the longer that signals will pass through the materials of the dielectric core 802 and the dielectric slab 804.

In one particular example, the circular dielectric polarizer 800 can be tuned to a center frequency of 44.5 GHz with a bandwidth of 2 GHz. The dielectric core 802 can be made of a material with a dielectric constant of K=2.54 and a loss tangent of 0.0005. The tapered dielectric slab 804 can be made of a material with a dielectric constant of K=5.4 and a loss tangent of 0.0005. The width 812 of the tapered dielectric slab 804 can be 20.5 mils, the depth 814 of the tapers 806 can be 15.8 mils, the diameter 810 of the circular dielectric polarizer 90 can be 114 mils, and the circular dielectric polarizer 800 can have a length 816 of 289 mils.

Figure 9B:
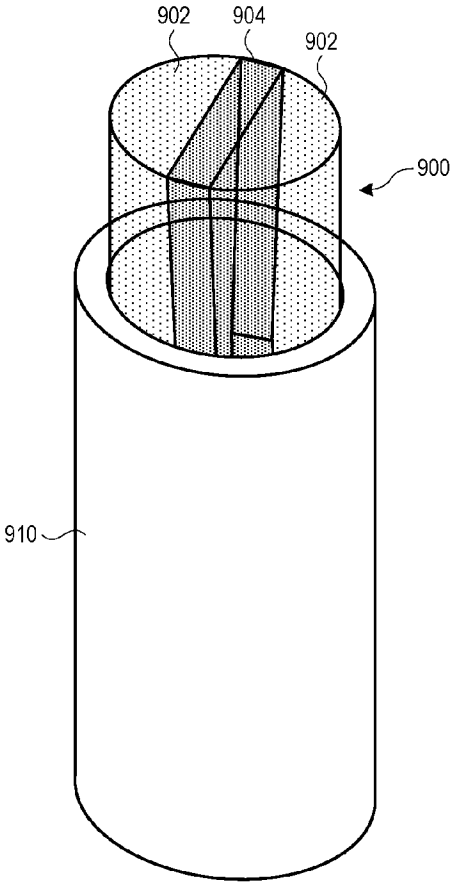
FIGS. 9A and 9B depict an example of how a circular dielectric polarizer can be formed.
Figure 9A:
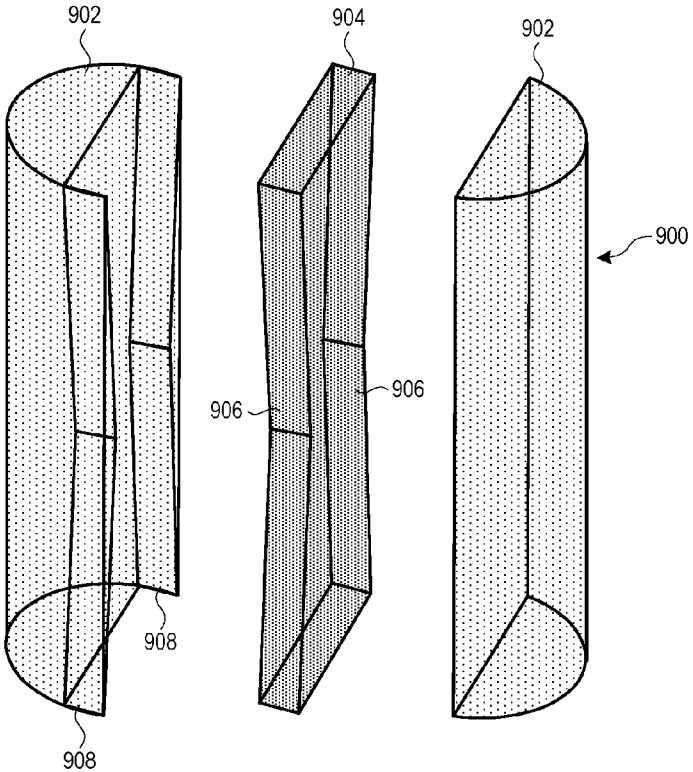

FIGS. 9A and 9B depict an example of how a circular dielectric polarizer 900 can be formed. The embodiment of the circular dielectric polarizer 900 depicted in FIGS. 9A and 9B has three pieces: two pieces that make up a dielectric core 902 and third piece that makes up a tapered dielectric slab 904 FIG. 9A. The tapered dielectric slab 904 can have tapers 906 along two of its sides. The tapers 906 (FIG. 9A) can have a particular depth from the edge of the circular dielectric polarizer 900. One or both of the two dielectric cores 902 can have protrusions 908 FIG. 9A that fill the void of the tapers 906 of the tapered dielectric slab 904. As shown in FIG. 9A, the three pieces of circular dielectric polarizer 900 can be formed separately. The dielectric cores 902 and the tapered dielectric slab 904 can be brought together, as shown in FIG. 9B, and slid inside of a container 910, such as a metal tube. The dimensions of each of the dielectric cores 902 and the tapered dielectric slab 904 can be such that, when the dielectric cores 902 and the tapered dielectric slab 904 are brought together and held in container 910, the dielectric cores 902 and the tapered dielectric slab 904 have the appropriate dimensions of the circular dielectric polarizer 900.

In the embodiment shown in FIG. 9B, the container 910 can be a metal tube that forms sidewalls, similar to the sidewalls 404 and 504 describes above with respect to FIGS. 4 and 5. The container 910 can serve to hold the dielectric cores 902 and the tapered dielectric slab 904 as well as provide sidewalls to that the circular dielectric polarizer 900 can also function as a waveguide.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

In general, the various features and processes described above may be used independently of one another, or may be combined in different ways. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. The example systems and components described herein may be configured differently than described. For example, elements may be added to, removed from, or rearranged compared to the disclosed examples.

While certain example or illustrative examples have been described, these examples have been presented by way of example only, and are not intended to limit the scope of the inventions disclosed herein. Indeed, the novel methods and systems described herein may be embodied in a variety of other forms. The accompanying claims and their equivalents are intended to cover such forms or modifications as would fall within the scope and spirit of certain of the inventions disclosed herein.

What is claimed is:

1. A method comprising:

receiving an input signal via a first end of a circular dielectric polarizer having a cylindrical shape, the circular dielectric polarizer comprising:

a dielectric slab comprising a first dielectric material, the dielectric slab having a thickness centered about an axis of the cylindrical dielectric polarizer, a dielectric core comprising a second dielectric material, a first portion of the dielectric core located on a first side of the dielectric slab and a second portion of the dielectric core located on a second side of the dielectric slab, wherein the first portion of the dielectric core, the dielectric slab and the second portion of the dielectric core form the cylindrical shape, and wherein a dielectric constant of the first dielectric material is higher than a dielectric constant of the second dielectric material, and at least one air cutout in each of the first portion and the second portion of the dielectric core;

wherein the at least one air cutout in each of the first portion and the second portion of the dielectric core has a substantially uniform cross section throughout the length of the circular dielectric polarizer;

passing the input signal through the circular dielectric polarizer, wherein parameters of the circular dielectric polarizer, the dielectric slab, the dielectric core, and the at least one air cutout cause approximately a 90 degree difference in phase of the input signal as it passes through the circular dielectric polarizer, said parameters including one or more of a thickness of the dielectric slab, a diameter of the circular dielectric polarizer, a length of the circular dielectric polarizer, a width of the at least one air cutout, and an air cutout diameter; and emitting an output signal from a second end of the circular dielectric polarizer, the output signal being phase-shifted by 90 degrees relative to the input signal.

2. The method of claim 1, wherein the input signal has frequency of approximately 44.5 GHz, and wherein the circular dielectric polarizer has a bandwidth of 2 GHz centered around 44.5 GHz.

3. The method of claim 1, further comprising:

guiding, by a container, the input signal through the circular dielectric polarizer, the container located around the dielectric slab, the dielectric core, and the at least one air cutout.

4. A circular dielectric polarizer having a cylindrical shape, the circular dielectric polarizer comprising:

a dielectric slab comprising a first dielectric material, wherein the dielectric slab has a thickness centered about an axis of the circular dielectric polarizer;

a dielectric core comprising a second dielectric material, a first portion of the dielectric core located on a first side of the dielectric slab and a second portion of the dielectric core located on a second side of the dielectric slab, wherein the first portion of the dielectric core, the dielectric slab and the second portion of the dielectric core form the cylindrical shape, and wherein a dielectric constant of the first dielectric material is higher than a dielectric constant of the second dielectric material; and at least one air cutout in each of the first portion and the second portion of the dielectric core;

wherein parameters of the circular dielectric polarizer, the dielectric slab, the dielectric core, and the at least one air cutout are selected to obtain approximately a 90 degree difference in phase in a signal passing through the circular dielectric polarizer at a target frequency, said parameters including one or more of a thickness of the dielectric slab, a diameter of the circular dielectric polarizer, a length of the circular dielectric polarizer, a width of the at least one air cutout, and an air cutout diameter;

wherein the at least one air cutout in each of the first portion and the second portion of the dielectric core has a substantially uniform cross section throughout the length of the circular dielectric polarizer.

5. The circular dielectric polarizer of claim 4, wherein the cross section of each air cutout comprises an arc-shaped cross section with a constant radius.

6. The circular dielectric polarizer of claim 4, wherein the parameters of the circular dielectric polarizer, the dielectric slab, the dielectric core, and the at least one air cutout further include one or more of a dielectric constant of the first dielectric material and a dielectric constant of the second dielectric material.

7. The circular dielectric polarizer of claim 4, further comprising:

a container located around the dielectric slab, the dielectric core, and the at least one air cutout.

8. The circular dielectric polarizer of claim 7, wherein the container has a cylindrical shape and holds the first portion of the dielectric core, the dielectric slab and the second portion of the dielectric core.

9. The circular dielectric polarizer of claim 7, wherein the container comprises a metal tube.

10. The circular dielectric polarizer of claim 4, wherein the target frequency is 44.5 GHz with a bandwidth of 2 GHz.

11. The circular dielectric polarizer of claim 4, wherein the at least one air cutout in the first portion of the dielectric core and the at least one air cutout in the second portion of the dielectric core are located symmetrically about the axis of the circular dielectric polarizer.

12. A circular dielectric polarizer having a cylindrical shape, the circular dielectric polarizer comprising:

a tapered dielectric slab comprising a first dielectric material, wherein the dielectric slab has a thickness centered about an axis of the cylindrical shape, wherein the tapered dielectric slab comprises a first tapered side at least a portion of which has a taper; and a dielectric core comprising a second dielectric material, a first portion of the dielectric core located on a first side of the tapered dielectric slab and a second portion of the dielectric core located on a second side of the tapered dielectric slab, wherein the first portion of the dielectric core, the tapered dielectric slab and the second portion of the dielectric core form the cylindrical shape, wherein a dielectric constant of the first dielectric material is higher than a dielectric constant of the second dielectric material, wherein at least one of the first portion of the dielectric core or the second portion of the dielectric core comprises a protrusion extended therefrom, and wherein the protrusion is configured to fill a void of the taper; and wherein parameters of the circular dielectric polarizer, the tapered dielectric slab, and the dielectric core are selected to obtain approximately a 90 degree difference in phase in a signal passing through the circular dielectric polarizer at a target frequency, said parameters including one or more of a thickness of the tapered dielectric slab, a diameter of the circular dielectric polarizer, a length of the circular dielectric polarizer, and a depth of a taper on the first tapered side.

13. The circular dielectric polarizer of claim 12, wherein the tapered dielectric slab comprises a second tapered side.

14. The circular dielectric polarizer of claim 13, wherein the first and second tapered sides are symmetrical about the axis of the cylindrical shape.

15. The circular dielectric polarizer of claim 12, wherein the parameters of the circular dielectric polarizer, the tapered dielectric slab and the dielectric core further include one or more of a dielectric constant of the first dielectric material and a dielectric constant of the second dielectric material.

16. The circular dielectric polarizer of claim 12, further comprising:

a container located around the tapered dielectric slab and the dielectric core.

17. The circular dielectric polarizer of claim 16, wherein the container has a cylindrical shape and holds the first portion of the dielectric core, the dielectric slab and the second portion of the dielectric core.

18. The circular dielectric polarizer of claim 16, wherein the container comprises a metal tube.

* * * * *